United States Patent [19]

Eisenlohr

[11] Patent Number: 4,589,450

[45] Date of Patent: May 20, 1986

[54] LENO ATTACHMENT FOR A WEAVING MACHINE

[75] Inventor: Franz Eisenlohr, Tuttwil, Switzerland

[73] Assignee: Sulzer Brothers Limited, Winterthur, Switzerland

[21] Appl. No.: 731,505

[22] Filed: May 7, 1985

[30] Foreign Application Priority Data

May 10, 1984 [EP] 05101984 ..... 84105316.8

[51] Int. Cl.[4] ..... D03D 47/40

[52] U.S. Cl. ..... 139/54

[58] Field of Search ..... 139/54, 430

[56] References Cited

U.S. PATENT DOCUMENTS

| | | | |
|---|---|---|---|
| 2,547,170 | 4/1951 | Picanol | 139/54 |
| 3,720,236 | 3/1973 | Strauss | 139/54 |
| 4,066,105 | 1/1978 | Heinrich et al. | 139/54 |

FOREIGN PATENT DOCUMENTS

| | | | |
|---|---|---|---|
| 1411838 | 8/1965 | France | 139/54 |

*Primary Examiner*—Henry S. Jaudon

*Attorney, Agent, or Firm*—Kenyon & Kenyon

[57] ABSTRACT

The leno attachment is provided with a leno yarn carrier which defines a pair of parallel yarn lanes, a standing yarn needle which may be integral with the carrier or separately spaced from the carrier and a deflecting lever for guiding a leno yarn from one yarn lane to the other in synchronism with a shed change. During deflection from one yarn lane to the other, the leno yarn is able to cross over the standing yarn from left to right and from right to left.

In other embodiments, the lever may be replaced by a pin wheel or a pivotally mounted spring.

The leno attachment may be used on different types of weaving machines include a jacquard weaving machine.

20 Claims, 22 Drawing Figures

LENO ATTACHMENT FOR A WEAVING MACHINE

This invention relates to a leno attachment for a weaving machine.

Various types of leno attachments have been known for use in weaving machines. For example, as described in German GMS No. 8227336. However, the known leno attachments are relatively complex and expensive.

Accordingly, it is an object of the invention to provide a leno attachment of simple construction.

It is another object of the invention to provide a leno attachment which is relatively inexpensive to produce.

It is another object of the invention to provide a leno attachment which can be used with a dobby weaving machine.

Briefly, the invention provides a leno attachment for a weaving machine which is comprised of a stationary carrier having at least one pair of spaced apart yarn lanes for guiding a leno yarn transversely therethrough and a passage communicating the lanes, a needle which is disposed in a plane located between the yarn lanes for guiding a standing yarn transversely therethrough and deflecting means in alignment with the passage for guiding a leno yarn from at least one yarn lane through the passage to the other yarn lane in synchronism with a shed change.

The leno attachment operates in association with a heddle by means of which the leno yarn can be moved in synchronism with the shed change. For example, with the leno yarn passing through one yarn lane in the stationary carrier, movement of the heddle, for example, upwardly causes the leno yarn to move to the upper end of the yarn lane where the leno yarn is then guided via the deflecting means to a position to be moved downwardly in the other yarn lane when the heddle moves downwardly. Likewise, when the heddle again moves upwardly, the leno yarn is moved to the upper end of this latter yarn lane to be guided by the deflected means into a position for return to the first yarn lane upon downward movement of the heddle.

During the movement of a leno yarn from one yarn lane to the other yarn lane, a crossing over of the standing yarn occurs. In this way, weft yarns which have been picked into a shed can be tied between the standing yarn and the leno yarn.

The leno attachment can be constructed to tie in every other weft yarn or may be constructed to tie in all the weft yarn ends.

In one embodiment, the deflecting means may include a lever which is movably mounted on the carrier in order to move between two end positions via the leno yarn so as to guide the leno yarn from one yarn lane to the other yarn lane. In addition, the deflecting means may include an inclined surface on the carrier which bounds the passage between the yarn lanes and which serves to guide the leno yarn from the second yarn lane back to the first yarn lane.

Where the deflecting means employs a lever, the lever may be provided with an indent for catching the leno yarn during movement from one yarn lane to the other yarn lane. In addition, a spring may be provided to bias the lever towards one of the end positions, for example in an end position in which the indent bridges over one yarn lane.

In another embodiment, the deflecting means may include a pair of levers which are movably mounted on the carrier with each lever having an indent in bridging relation to a respective yarn lane.

In another embodiment, the deflecting means may be in the form of a pin wheel which is rotatably mounted adjacent to the passage between the yarn lanes. In this embodiment, rotation of the pin wheel serves to guide a leno yarn from one yarn lane to the other.

In still another embodiment, the standing yarn needle may be integral with the carrier rather than being a separate element disposed in spaced apart relation to the carrier.

The leno attachment may also be made of multiple construction, for example with two pairs of spaced apart yarn lanes and associated deflecting means.

Where the leno attachment is used for a dobby weaving machine, the standing yarn needle may be mounted on a movable shaft for movement in a plane between the yarn lanes of the stationary carrier in synchronism with a shed change. In this respect, the movement of the needle may be synchronized with the shed as well as the movement of a heddle for the leno yarn in order to tie in all of the weft yarn ends.

These and other objects and advantages of the invention will become more apparent from the following detailed description in conjunction with the accompanying drawings wherein.

Figure 1:
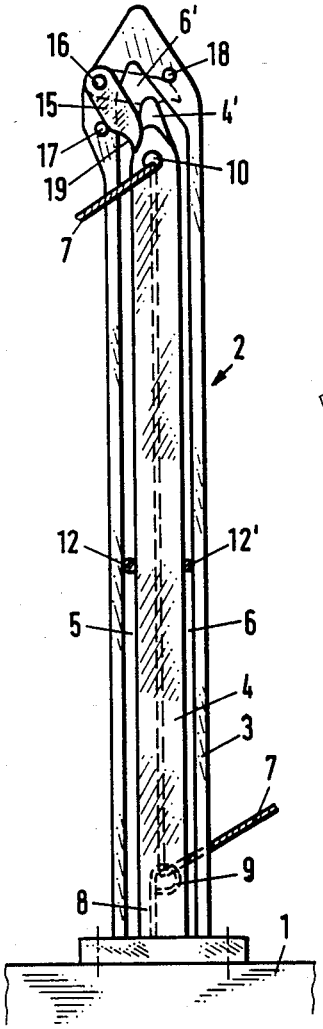
FIG. 1 illustrates a front view of a leno attachment constructed in accordance with the invention.
Figure 3A:
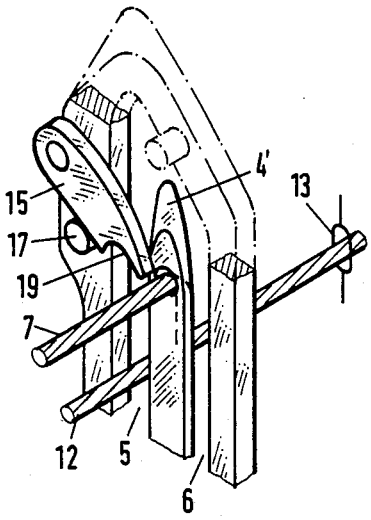
Figure 3B:
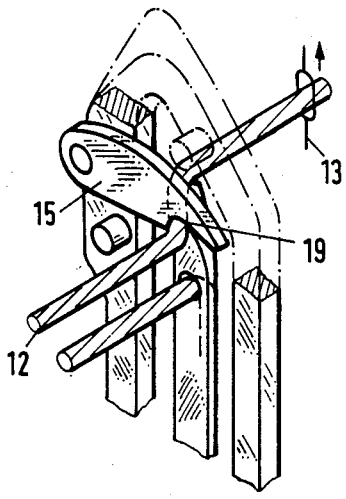
Figure 3C:
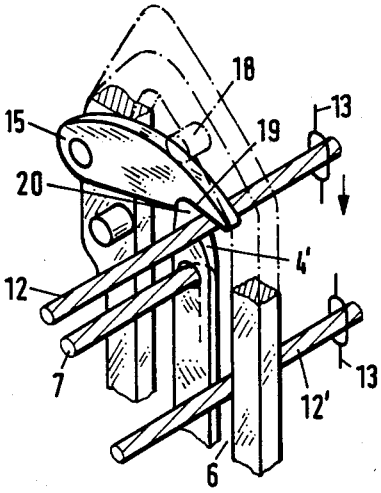
Figure 3D:
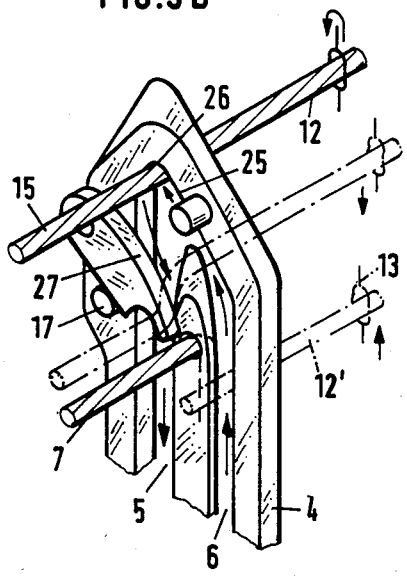
Figure 4:
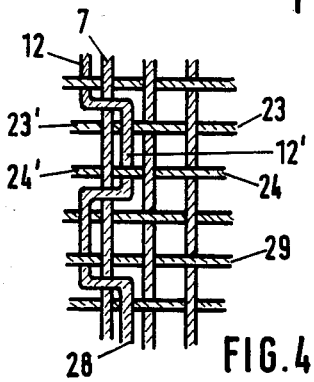
Figure 5:
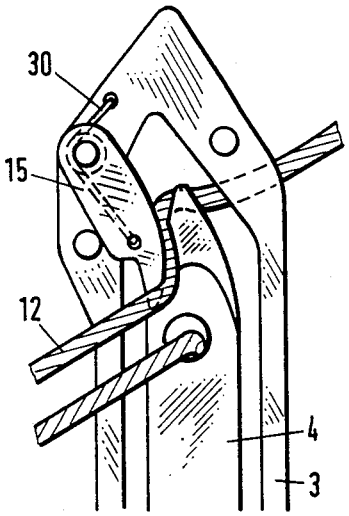
Figure 6:
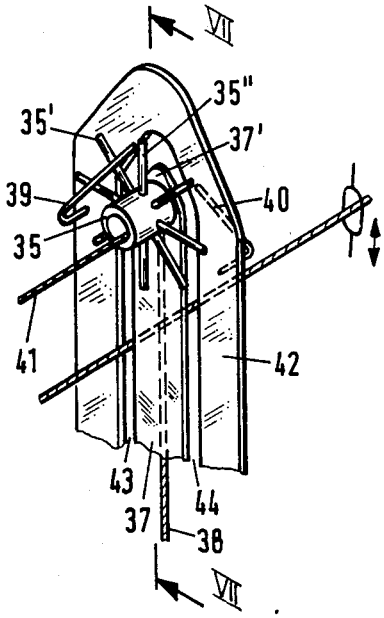
Figure 8:
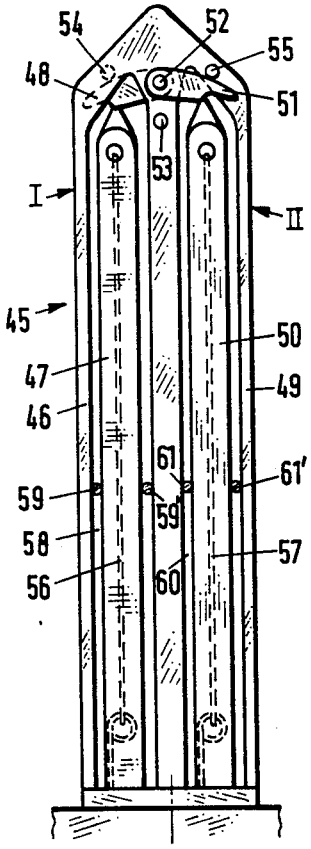
Figure 7:
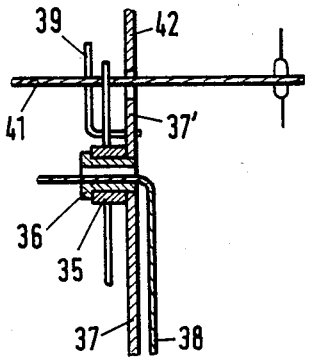
Figure 9:
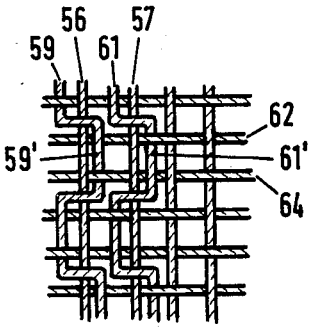
Figure 10:
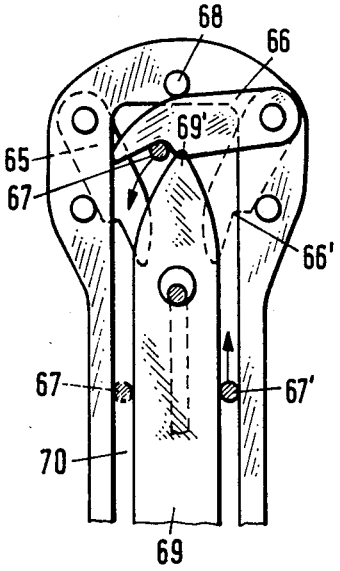
Figure 11:
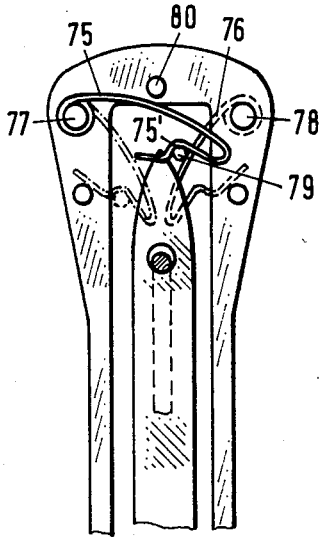
Figure 12:
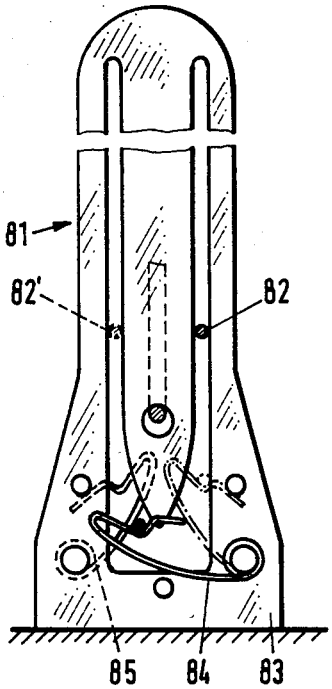
Figure 13:
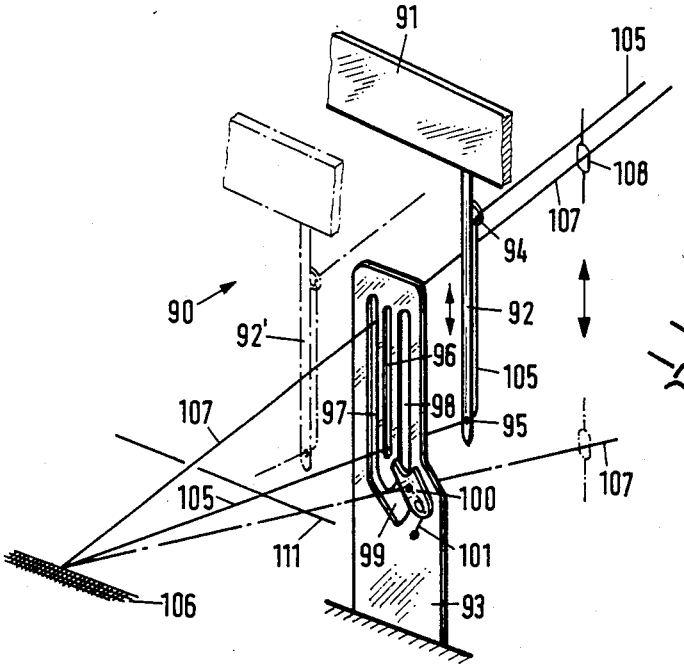
Figure 14:
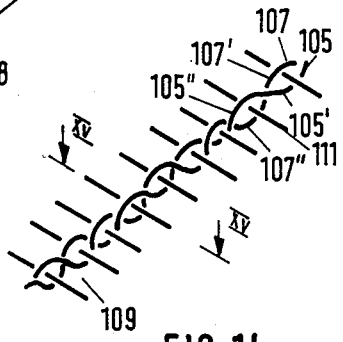
Figure 15:
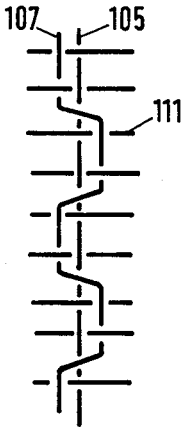
Figure 16:
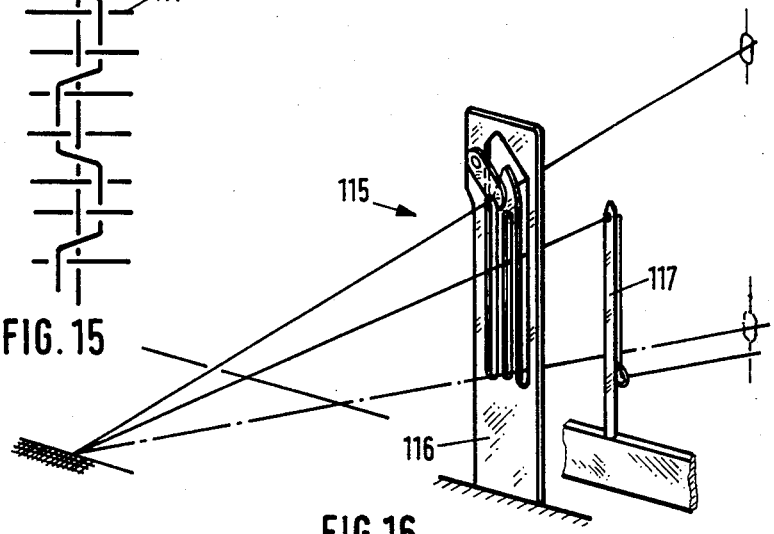
Figure 17:
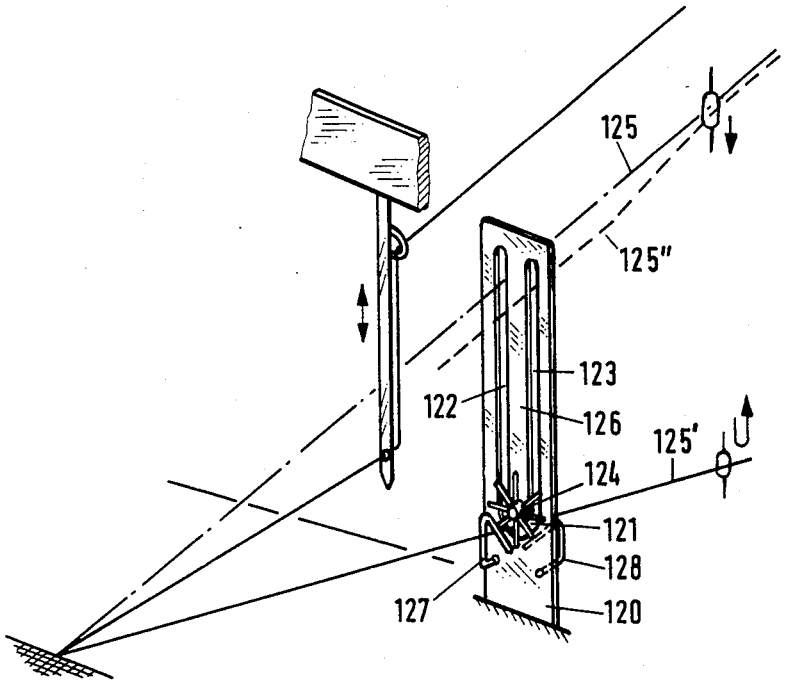
Figure 18:
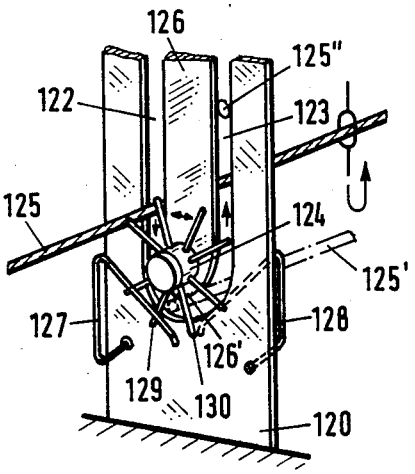
Figure 19:
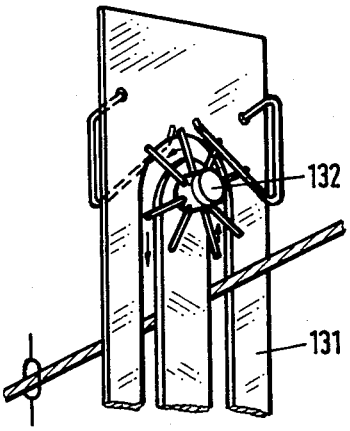

FIG. 3*a* illustrates the leno attachment of FIG. 1 in a position prior to movement of a leno yarn from one yarn lane;

FIG. 3*b* illustrates a view similar to FIG. 3*a* of the leno attachment with a leno yarn in a position of transfer;

FIG. 3*c* illustrates a view of the leno attachment with a leno yarn being transferred into a yarn lane;

FIG. 3*d* illustrates a view of the leno attachment during a return of a leno yarn to the initial yarn lane;

FIG. 4 illustrates a partial view of a fabric having a selvedge formed by the leno attachment of FIG. 1;

FIG. 5 illustrates a modified leno attachment with a spring biased deflecting means;

FIG. 6 illustrates a leno attachment using a pin wheel as a deflecting means;

FIG. 7 illustrates a view taken on line VII—VII of FIG. 6;

FIG. 8 illustrates a front view of a dual leno attachment according to the invention;

FIG. 9 illustrates a partial view of a fabric having a double selvedge formed by the leno attachment of FIG. 8;

FIG. 10 illustrates a leno attachment utilizing a pair of levers for the deflecting means in accordance with the invention;

FIG. 11 illustrates a modified leno attachment employing a pair of springs as the deflecting means in accordance with the invention;

FIG. 12 illustrates a leno attachment mounted in a reversed manner from that of FIG. 1;

FIG. 13 illustrates a leno attachment for use with a dobby weaving machine in accordance with the invention;

FIG. 14 illustrates a selvedge formed by the leno attachment of FIG. 13;

FIG. 15 illustrates a plan view taken on line XV—XV of FIG. 14;

FIG. 16 illustrates a modified leno attachment for a dobby moving machine in accordance with the invention;

FIG. 17 illustrates a further modified leno attachment for a dobby weaving machine;

FIG. 18 illustrates an enlarged view of the bottom of the carrier of the leno attachment of the leno attachment of FIG. 17; and FIG. 19 illustrates a view similar to FIG. 18 of a carrier of a leno attachment mounted in reversed manner.

Referring to FIG. 1, the leno attachment 2 is mounted on a stationary part 1 of a weaving machine, for example a jacquard weaving machine. In this respect, the leno attachment 2 is secured near the weaving edge of a fabric being produced on the weaving machine.

Figure 2:
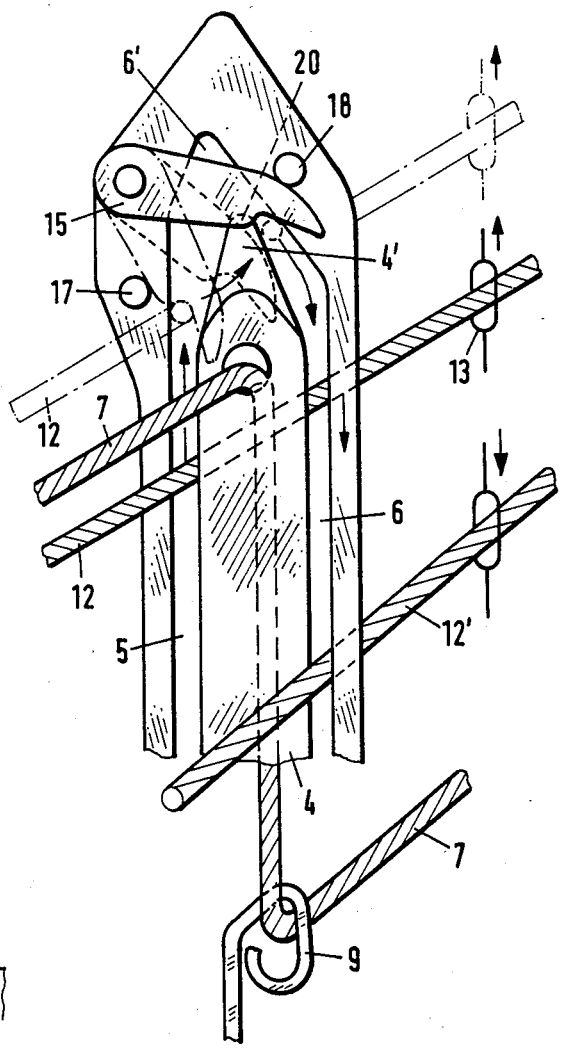
FIG. 2 illustrates an enlarged view of a part of the leno attachment of FIG. 1.

Referring to FIGS. 1 and 2, the leno attachment 2 includes a frame-like stationary carrier 3 and a needle 4 which is integral with the carrier 3 so as to form a web. The carrier 3 has a pair of parallel spaced apart yarn lanes 5, 6 for guiding a leno yarn 12 transversely therethrough and a passage 6' which communicates the lanes 5, 6 in end-to-end relation. As indicated, the needle 4 is disposed in a plane located between the yarn lanes 5, 6 for guiding a standing yarn 7 transversely therethrough. This yarn 7 is supplied from a supply bobbin (not shown) and extends through a yarn carrier 9 disposed on the back of the attachment 2 at the bottom 8 thereof. Thereafter, the yarn 7 rises and passes through an eye 10 in the upper end of the needle 4 and then passes to the apex of a weaving shed (not shown).

The standing yarn 7 is a separate yarn which accompanies the warp at the edge of the fabric but is not guided by a heddle and, therefore, does not participate in a shed change.

The leno yarn 12 is a normal warp yarn which is paid off from a warp beam and which is guided by a heddle 13 (see FIG. 2) of a jacquard machine (not shown). This leno yarn 12 passes alternately through the yarn lanes 5, 6 of the carrier 3 to the shed apex in a manner to be described hereinafter. Of note, the leno yarn in the yarn lane 6 has the reference 12'.

The leno attachment 2 also has a deflecting means mounted on the carrier 3 in alignment with the passage 6' for guiding the leno yarn from one yarn lane to the other yarn lane in synchronism with a shed change in the weaving machine whereby the leno yarn 12 crosses over the standing yarn 7. For example, as shown in FIG. 2, the deflecting means 2 includes a lever or junction 15 which is freely rotatable about a pin mounted on the carrier 3 to move between two end positions defined by abutments 17, 18 on the carrier 3. As indicated in FIG. 1, in a rest position, the lever 15 has an indent 19 which bridges the yarn lane 5 on the left side of the carrier 3, as viewed. When in the extended position shown in FIG. 2, the lever 15 abuts the abutment 18 to permit the leno yarn 12 to pass into the yarn lane 6.

Referring to FIG. 2, the needle 4 narrows at the apex 4' to bound a gap 20 between the apex 4' and the lever 15.

In operation, before the start of a leno movement, the leno yarn 12 is in the left-hand lane 5 and the lever 15 is in the position shown in FIG. 3*a*, i.e. in engagement with the abutment 17. When the heddle 13 raises the leno yarn 12 in a top-shedding movement, the yarn 12 rises in the yarn lane 5 and moves the lever 15 upwardly (FIG. 3*b*) until the lever 15 reaches abutment 18 (FIG. 3*c*). At this time, the yarn 12 is passed over the needle apex 4' by way of the indent 19 and gap 20.

After a weft yarn 23 (see FIG. 4) has been picked, the shed changes. The heddle 13 then lowers and pulls the leno yarn 12 into the yarn lane 6 until reaching the bottom shed position indicated in FIG. 1 by the leno yarn position 12'. During descent, the leno yarn 12 crosses over the standing yarn 7 and the just-picked weft yarn 23 from left to right (see FIG. 4). At the same time, the lever 15 returns to the abutment 17, for example under gravity.

The next weft 24 (see FIG. 4) is then picked. Thereafter, the shed changes to the top shed position with the heddle 13 lifting the leno yarn 12 through the lane 6 (see FIG. 3*d*) and along the inclined surface or edge 25 of the carrier 3 which bounds the passage 6'. During this time, the leno yarn 12' first crosses under the last-picked weft yarn 24 from right to left and then crosses over the standing yarn 7 as indicated in FIG. 4.

When the leno yarn has reached a niche 26 in the carrier 3, the shed changes to the bottom shed position. At this time, the heddle 13 pulls the leno yarn 12 along a top edge 27 of the lever 15 into the yarn lane 5. At this time, the weft yarn 24 has been tied between the standing yarn 7 and the leno yarn 7. The leno cycle therefore ends and the next leno cycle can take place in the same way so that, in the end, a selvage 28 is produced on the fabric 29.

Referring to FIG. 5, in order to obviate any possible delayed operation or sticking of the lever 15, a spring 30 may be mounted on the carrier to bias the lever 15 against the lower abutment 17. This spring 30 permanently applies pressure to the lever 15 so that the lever 15, having deflected to allow a leno yarn through, is sure to return to the initial position in engagement with the abutment 17.

Referring to FIGS. 6 and 7, the deflecting means employed on the leno attachment may be in the form of a pin wheel 35 which is rotatably mounted about a bush or sleeve 36 secured in the standing-yarn needle 37. In this case, the sleeve 36 may also serve as an eyelid for a standing yarn 38. In addition, a pair of guide stirrups 39, 40 may be mounted on the front and back of the carrier 42 to guide the leno yarn 41 within the spokes of the pin wheel 35. As indicated, each stirrup 39, 40 is of L-shape and projects over the plane of the spokes of the pin wheel at the upper end of each yarn lane 43, 44.

The leno attachment of FIG. 6 operates in a similar manner to the leno atttachment of FIGS. 1 to 4. That is, when a leno yarn 41 rises in the left-hand 43 during the top shedding motion, the yarn 41 moves between two pins or spokes of wheel wheel 35 and rotates the wheel 35 clockwise, as viewed. During this time, the leno yarn 41 is forced onto the stirrup 39 and is guided towards the center of the yarn carrier 42 until reaching the top position therein. The leno yarn 41 is then disposed between the top 2 pins 35', 35" as viewed in FIG. 6.

During the next shed change, the leno yarn 41 descends and, in doing so, is deflected by the momentum of the pin wheel 35 over the apex 37" of the needle 37 into the right-hand lane 44. The yarn 41 then passes downwardly until reaching the bottom shed position. During this time, the leno yarn 41 crosses over the standing yarn 38.

At the next shed change, the leno yarn moves upwardly in the yarn lane 44, engages the pin wheel 35 and rotates the pin wheel 35 in a counter-clockwise manner. During this time, the leno yarn is guided via the stirrup 40 to the center of the yarn carrier 42 and is thereafter deflected by the pin wheel 35 into the left-hand lane.

On the next shed change, the yarn 41 moves downwardly within the yarn lane 43.

In the case of the above-described leno attachments, the end of every other weft yarn remains free, that is, the weft yarn is not tied in by the leno yarn. As in apparent from FIG. 4, one end 23' of the weft yarn 23 is not tied in but one end 24' of a weft 24 is tied in since the latter end is disposed between the standing yarn and the leno yarn 12.

Referring to FIG. 8, a dual leno attachment may be provided to ensure that all the weft yarn ends are tied in within a fabric. As illustrated, the dual leno attachment 45 has a pair of attachments I, II. One attachment I comprises a leno yarn carrier 46, a standing yarn needle 47 and a lever 48. The other leno attachment II comprises a leno yarn carrier 49, a standing yarn needle 50 and a lever 51. Both levers 48, 51 are rotatable about a common pin 52 and are both shown in a raised position. Further, the lever 48 which is on the back of the attachment moves between two abutments 53, 54 while the other lever 51 is disposed on the front of the attachment and moves between the common abutment 53 and another abutment 55 on the front of the attachment. Each attachment I, II also carries a standing yarn 56, 57, respectively.

Before the start of a leno movement, a leno yarn 59 is disposed in the left-hand yarn lane 58 of attachment I while a leno yarn 61 is disposed in the left-hand lane 60 of the attachment II.

The operation of the dual leno attachment is similar to the above described attachments. In this respect, attachment I is responsible for crossing the leno yarn 59 over the standing yarn 56 and a weft yarn 62 (see FIG. 9) from left to right. Simultaneously, the attachment II is responsible for crossing the leno yarn 61 over the standing yarn 57 and for crossing the leno yarn 61 below the weft yarn 62 also from left to right. Thereafter, the leno yarn 59' of attachment I crosses under a weft yarn 64 from right to left and crosses over the standing yarn 56 while the other leno yarn 61' of attachment II crosses over the weft yarn 64 and standing yarn 57 from right to left. This corresponds to half of a leno cycle. The operation then proceeds but in a converse sequence until the conclusion of the complete leno cycle.

Since the leno yarns 59, 61 of the dual attachment move in opposite directions, every weft yarn is tied in since every end is disposed between a standing and a leno yarn pair.

Of note, the dual attachment of FIG. 8 may be further modified to provide a multiplicity of attachments.

Referring to FIG. 10, the leno attachment may be constructed with a deflecting means which employs a pair of levers 65, 66. In this case, one lever 65 is mounted on the back of the attachment while the other lever 66 is mounted on the front of the attachment. Each of these levers 65, 66 serves the same purpose as the lever 15 described with respect to FIG. 1.

As illustrated in FIG. 10, the attachment is positioned for a leno movement of a leno yarn 67' from right to left. Thereafter, during operation, the yarn 67' first engages in the indent 66' of the lever 66 to raise the lever 66 until abutting against the abutment 68. The yarn 67' then slids to the left over the apex 69' of a standing yarn needle 69.

Thereafter, during a shed change, the leno yarn 67 passes downwardly past the lever 65 and the needle apex 69' into the left-end yarn lane 70. The leno cycle is then at an end.

Referring to FIG. 11, instead of using a solid lever, use may be made of a one-piece wire spring 75, 76 of hook shape. As indicated, each spring 75, 76 has a contour similar to that of the lever 65, 66 of FIG. 10.

Each spring 75, 76 is secured to a stationary pin 77, 78, respectively on the front and back of the attachment. In addition, each spring has an indent 75' for catching a leno yarn therein.

The springs 75, 76 function in the same way as the levers previously described. One advantage of using a wire spring of this type is that as soon as the spring is forced upwardly by a leno yarn 79, the movement of the leno yarn in the indent 75' over the apex of the standing yarn needle is boosted. In this regard, the indent is displaced and superimposes this displacement upon the pivoting radius of the spring 75, 76.

Referring to FIG. 12, the leno attachment 81 for guiding a leno yarn 82, 82' from one yarn lane to another may have a passage connecting the yarn lanes at a bottom part 83 of the attachment 81. In this regard, the leno attachment is disposed in a position rotated 180° from the positions as illustrated, for example in FIG. 1. In addition, a pair of wire springs 84, 85, as above, are provided on the front and back of the attachment at the bottom end 83. The operation of the attachment is the same as that for the leno attachment of FIG. 11.

The leno attachments which have been described can be used advantageously, but not exclusively in jacquard weaving machines particularly since it has been impossible to use commercially available facilities in such machines. The leno attachments to be described hereinafter are more concerned with weaving machines where a shed change is produced by means of shafts.

Referring to FIG. 13, the leno attachment includes a standing yarn needle 92 which is secured to a movable shaft 91 of a weaving machine (not shown). The attachment also includes a leno yarn carrier 93 which is fixedly secured to the weaving machine.

The needle 92 includes an eyelet or yarn carrier 94 at the top end and a yarn eye 95 at the bottom end in order to guide a standing yarn 105 therethrough to a fabric 106.

The yarn carrier 93 has a third yarn lane 96 which is centrally located in a plane between the side lanes 97, 98. As above, the side lanes 97, 98 communicate with one another by means of a passage 99. In addition, a deflecting means in the form of a lever 100 is mounted on the carrier 93 with an indent which bridges over the yarn lane 98. A spring 101 is also provided to permanently bias the lever 100 upwardly against an abutment (not shown) against the force of gravity.

As indicated, the standing yarn 105 is supplied from a supply bobbin (not shown) and passes through the eyelet 94 and eye 95 of the yarn carrier 93 and the central lane 96 of the carrier 93 to the fabric 106.

A leno yarn 107 is paid off from a warp beam and passes through a heddle 108 of a shaft (not shown) behind the shaft 91 and then passes through the carrier 93 to the fabric 96.

With the heddle 108 in the top shed position illustrated, the leno yarn 107 is in the left-hand lane 97 of the carrier 93 whereas, with the heddle 108 in the bottom shed position, the leno yarn 107 would be in the right-hand lane 98.

The shaft 91 is movable so as to move the needle 92 in the plane of the central yarn 97 in synchronism with a shed change.

During operation, starting with the position shown in FIG. 13, when the heddle 108 descends towards the bottom shed position, the leno yarn 17 slids down through the lane 97 and terminates in a position 107' in the aperture 99 of the carrier 93. Simultaneously, the shaft 91 raises the needle 92 carrying the standing yarn 105 into the top shed position. The leno yarn 107 and the standing yarn 105 have therefore crossed one another. In FIG. 14, the leno yarn 107' is shown in the selvage 109 and the standing yarn is shown at 105'.

With the standing yarn 105 now at the top in the central yarn lane 96, a weft yarn 111 is picked.

At the next shed change of the two shafts, the standing yarn 105 and the leno yarn 107 cross one another again, this time with the inclusion between them of the weft yarn 111. During this time, the leno yarn 107 rises passed the lever 100 into the right-hand lane 98 while the standing yarn 105 is again at the bottom of the central lane 96. In FIG. 14, references 105" denotes the path of the standing yarn and the reference 107" denotes the path of the leno yarn.

The weft yarn 111 is thus tied in and a leno cycle has come to an end.

FIG. 14 shows the selvedge 109 which is produced.

Referring to FIG. 15, which is a plan view of the selvedge 109 of FIG. 14, the standing yarn 105 retains its linearity during the leno operation. However, the leno yarn 107 changes over from one side of the standing yarn 105 to the other after each crossing-over of a weft yarn 111.

Referring to FIG. 13, the leno attachment may be modified so that the needle can be disposed downstream of the carrier 93. This position is shown in chain dotted lines. In this arrangment, the central lane 96 of the carrier 93 is unnecessary. This arrangement also has the advantage that both the leno yarn and the standing yarn can be disposed in a bottom-shed plane.

Referring to FIG. 16, the leno attachment 115 may be constructed so that the leno yarn carrier 116 and the standing yarn needle 17 are turned upside down as compared with the arrangement of FIG. 13. The operation of the leno attachment 115 is the same as that of the leno attachment of FIG. 13. Of note, an arrangement of this kind may be necessary for space conditions in a weaving machine.

Referring to FIGS. 17 and 18, the leno attachment for a dobby weaving machine may be constructed with a carrier 120 having a pin wheel 124 for guiding a leno yarn 125 in a passage 121 between two lanes 122, 123. As above described, the pin wheel 124 is freely rotatable on a central web 126 and cooperates with a guide stirrup 127 which is mounted on the front of the carrier 120 and a guide stirrup 128 which is mounted on the back of the yarn carrier 120. In other respects and as in FIG. 13, the attachment has a standing yarn needle downstream of the carrier 93. The operation of this attachment is similar to that of the attachment of FIG. 13.

When the leno yarn 125 moves in the lane 122 from the top shed position shown into the bottom shed position, the leno yarn rotates the pin wheel 124 counterclockwise. At this time, the momentum of the pin wheel 124 acts by way of the stirrup 127 to force the leno yarn 125 sideways until reaching the bottom position 125' in the yarn carrier 120. The leno yarn 125' is then disposed between the lowermost pins 129, 130 to the right of the apex 126' of the central web 126 as indicated in FIG. 18. During the immediately following movement towards the top shed position, the pin wheel is further rotated and the leno yarn is changed over into the lane 123 and moves upwardly into the position 125". During the next shed change, the leno yarn 125" rotates the pin wheel 124 clockwise and returns into the lane 125.

Referring to FIG. 19, a leno carrier 131 may have a pin wheel 132 disposed in a top part. In this case, the associated yarn needle (not shown) is now upwardly directed as in FIG. 16 but is downstream of the carrier with respect to the direction of the warp.

The invention thus provides a leno attachment which is of relatively simple and inexpensive construction.

Further, the invention provides a leno attachment which can be readily incorporated into existing weaving machines.

What is claimed is:

1. A leno attachment for a weaving machine comprising a stationary carrier having at least one pair of spaced apart yarn lanes for guiding a leno yarn transversely therethrough and a passage communicating said lanes in end-to-end relation;

a needle disposed in a plane located between said yarn lanes for guiding a standing yarn transversely therethrough; and deflecting means mounted on said carrier in alignment with said passage for guiding a leno yarn from at least one yarn lane through said passage to the other yarn lane in synchronism with a shed change in the weaving machine whereby the leno yarn crosses over the standing yarn.

2. A leno attachment as set forth in claim 1 wherein said deflecting means includes a lever movably mounted on said carrier to move between two end positions by the leno yarn to guide the leno yarn from one yarn lane to the other yarn lane and an inclined surface on said carrier bounding said passage to guide the leno yarn from said other yarn lane to said one yarn lane.

3. A leno attachment as set forth in claim 2 wherein said lever has an indent for catching the leno yarn during movement from said one yarn lane.

4. A leno attachment as set forth in claim 2 which further comprises a spring biasing said lever towards one of said end positions.

5. A leno attachment as set forth in claim 2 wherein said lever is a one piece wire spring of hook shape with an indent for catching the leno yarn.

6. A leno attachment as set forth in claim 2 which further comprises a pair of abutments on said carrier to define said end positions of said lever.

7. A leno attachment as set forth in claim 1 wherein said deflecting means includes a pair of levers movably mounted on said carrier, one of said levers being movable to guide the leno yarn from one yarn lane to the other yarn lane and the other of said levers being movable to guide the leno yarn from said other yarn lane to said one yarn lane.

8. A leno attachment as set forth in claim 7 wherein said levers are mounted in a bottom part of said carrier.

9. A leno attachment as set forth in claim 1 wherein said needle is integral with said carrier and said deflecting means is a pin wheel rotatably mounted on said needle.

10. A leno attachment as set forth in claim 9 wherein said pin wheel includes a hollow hub for passage of the standing yarn therethrough.

11. A leno attachment as set forth in claim 1 wherein said needle is spaced from said carrier and said deflecting means is a pin wheel rotatably mounted on said carrier adjacent said passage.

12. A leno attachment as set forth in claim 1 wherein said carrier includes two pairs of spaced apart yarn lanes and a pair of passages, each said passage communicating said lanes of a respective pair of yarn lanes in end-to-end relation to guide a respective one of two leno yarns therebetween and which further comprises a pair of deflecting elements mounted on said carrier, each said deflecting element being disposed adjacent a respective pair of yarn lanes to guide a leno yarn from one yarn lane to the other yarn lane thereof.

13. A leno attachment for a weaving machine comprising a stationary carrier having at least one pair of spaced apart yarn lanes for guiding a leno yarn transversely therethrough and a passage communicating said lanes;

a needle integral with said carrier between said lanes for guiding a standing yarn transversely therethrough; and deflecting means mounted on said carrier for guiding a leno yarn from at least one yarn lane through said passage to the other yarn lane in synchronism with a shed change to cross the leno yarn over the standing yarn.

14. A leno attachment for a dobby weaving machine comprising a stationary carrier having at least one pair of spaced apart yarn lanes for guiding a leno yarn transversely therethrough and a passage communicating said lanes;

deflecting means mounted on said carrier in alignment with said passage for guiding a leno yarn from at least one yarn lane through said passage to the other yarn lane in synchronism with a shed change;

a needle disposed in a plane located between said yarn lanes for guiding a standing yarn transversely therethrough; and a movable shaft mounting said needle thereon for moving said needle in said plane in synchronism with a shed change.

15. A leno attachment as set forth in claim 14 wherein said carrier includes a third yarn lane in said plane for passage of the standing yarn therethrough and said needle is disposed upstream of said carrier relative to the movement of warp yarns in the machine.

16. A leno attachment as set forth in claim 14 wherein said needle is disposed downstream of said carrier relative to the movement of warp yarns in the machine.

17. A leno attachment as set forth in claim 14 wherein said deflecting means is a lever pivotally mounted on said carrier.

18. A leno attachment as set forth in claim 14 wherein said lever is mounted at the bottom of said carrier and which further comprises a spring biasing said lever upwardly against gravity.

19. A leno attachment as set forth in claim 14 wherein said deflecting element is a pin wheel rotatably mounted on said carrier.

20. A leno attachment as set forth in claim 19 which further comprises a guide stirrup mounted on at least one side of said carrier adjacent said pin wheel to guide a leno yarn within said pin wheel.

* * * * *